US005111672A

United States Patent [19]

Gille et al.

[11] Patent Number: 5,111,672

[45] Date of Patent: May 12, 1992

[54] WEFT THREAD INSERTION ARRANGEMENT

[75] Inventors: Friedrich Gille, Obertshausen; Rolf Naumann, Muhlheim; Gerhard Bergmann, Heusenstamm, all of Fed. Rep. of Germany

[73] Assignee: Karl Mayer Textilmaschinenfabrik GmbH, Obertshausen, Fed. Rep. of Germany

[21] Appl. No.: 588,654

[22] Filed: Sep. 26, 1990

[30] Foreign Application Priority Data

Sep. 27, 1989 [DE] Fed. Rep. of Germany ..... 3932184

[51] Int. Cl.[5] ..... D04B 23/12

[52] U.S. Cl. ..... 66/84 A; 28/101; 28/102

[58] Field of Search ..... 66/84 A, 205; 28/101, 28/102, 184, 185

[56] References Cited

U.S. PATENT DOCUMENTS

| | | | |
|---|---|---|---|
| 3,593,394 | 7/1971 | Bolles | 66/84 A X |
| 4,068,357 | 1/1978 | Goldsworthy et al. | 28/101 |
| 4,395,888 | 8/1983 | Wilkens | 66/84 A |
| 4,487,039 | 12/1984 | Mayer | 66/84 A |
| 4,528,631 | 7/1985 | Bogucki-Land | 55/205 X |
| 4,703,631 | 11/1987 | Naumann et al. | 66/84 A |
| 4,761,973 | 8/1988 | Gangi | 66/204 |
| 4,793,158 | 12/1988 | Liebrandt | 66/84 A |

FOREIGN PATENT DOCUMENTS

| | | | |
|---|---|---|---|
| 2519762 | 11/1976 | Fed. Rep. of Germany | 66/84 A |
| 2097934 | 5/1987 | Japan | 28/184 |

*Primary Examiner*—Werner H. Schroeder
*Assistant Examiner*—John J. Calvert
*Attorney, Agent, or Firm*—Omri M. Behr

[57] ABSTRACT

A weft thread insertion arrangement for the weft thread magazine of a warp knitting machine has a warp thread laying insert carriage. The carriage, in conjunction and cooperation with the main shaft of the warp knitting machine, is driven between two forwarding devices for forwarding the laid weft threads to a needle bed. The arrangement has a drive assembly including a computer and a servomotor. The computer has at least one data storage device for taking up the data associated with at least one movement path formula. A sensor is provided for determining the number of revolutions and the angular displacement position data of the main shaft, which is fed back to the computer to enable it to compute the required drive speed of the servomotor.

17 Claims, 6 Drawing Sheets

19
17
15
S
16
18
M
25
A
27
29
28
26
21
22
13
11
23
10
14
S
24
9
2
20
12
5
X
6
1

WEFT THREAD INSERTION ARRANGEMENT

The present invention relates to a weft thread provision arrangement for the weft thread magazine of a warp knitting machine, and, in particular, to a weft carriage carrying weft threads between a pair of transport means for transporting the laid weft threads to a needle bed, the weft carriage being driven by a drive means, in dependence upon the main shaft of a warp knitting machine.

In the known arrangements of the prior art, the weft carriage is driven from the main shaft by a mechanical gear unit (either with a reduction gear arrangement and/or a crank mechanism driven from the main shaft). The motion path formula is strictly prescribed and generally corresponds to a sinusoidal speed/time relationship of the weft carriage. This gives rise to uneven loads on the weft threads pulled from the creel spools. Furthermore, often the thread takeoff speed does not correspond to the speed of the weft carriage; for example, when the thread sheet is pulled over a common turning roller located above the path of the weft threads.

For this reason, it is known (DE OS 32 34 827) to provide a roller delivery arrangement to the weft thread provision arrangements of the prior art. This roller delivery arrangement is located between the creel spools and the thread guides. The drive of the roller delivery arrangement is continually adjustable to take into account the speed of the weft carriage and its position at a particular point in time. By means of such a roller delivery arrangement, weft threads can be provided at the same speed at which they are laid.

Thus, the drive speed of the delivery means can be pre-set in dependence upon the speed and position of the weft carriage, by means of a computer arrangement equipped with a program storage means Such a roller delivery means however requires additional expenditure in construction.

It is further known (DE OS 24 51 731) to drive the thread guides of a warp knitting machine through a separate servomotor, for example, a pneumatic cylinder, a hydraulic angular displacement transducer or a digitized direct current motor Provisions for the reduction of thread tension however are not provided therein.

Accordingly, an object of the present invention is to provide a weft thread provision arrangement of the type generally described in the prior art, but without a roller delivery means, and with a means for taking into account the material properties of the weft threads or the conditions of the thread provision. Specifically, an object is to deliver weft threads with lower tension variations, and lower peak tensions than was heretofore possible.

SUMMARY OF THE INVENTION

In accordance with the illustrative embodiments demonstrating features and advantages of the present invention, there is provided a weft thread insertion arrangement for the weft thread magazine of a warp knitting machine The warp knitting machine is adapted to receive weft thread and has a main shaft and a needle bed. The weft thread insertion arrangement has an insert carriage for laying weft thread and two forwarding means for forwarding to the needle bed the weft threads laid by the insert carriage Also included is a drive means for driving the insert carriage to travel between the two forwarding means. The drive means is adapted to be regulated by the main shaft of the warp knitting machine The drive means includes a computer provided with at least one data storage means and programed to process data under at least one predetermined movement path formula. A servomotor is coupled to the computer. The weft thread insertion arrangement also has a sensor coupled to the computer for providing thereto a sensor signal responsive to the number of revolutions and the angular displacement position of the main shaft to enable the computer to compute from the sensor signal a target drive speed value for the servomotor based upon the sensor signal and based upon the predetermined movement path formula.

Significant advantages arise from employing apparatus of the foregoing type. The drive means employs a computer and a servomotor controlled thereby. The computer is provided with a storage means at least containing the motion path formula The preferred sensor is provided for the determination of the main shaft data, including at least the number of rotations and the rotational position. The computer can determine the required drive speed of the servomotor by considering these main shaft data as well as the data inherent in the motion path formula.

In the preferred construction, the back and forth movement of the weft insert carriage must still be carried out within a predetermined cycle of time but within each segment of the laying cycle the weft insert carriage can be driven with an appropriate speed that would be optimal for the weft threads utilized. In particular, the drive speed is not dependent upon a particular function which is determined by the mechanical gear unit between the main shaft and the weft carriage. Rather, the utilization of a computer, in particular a digital computer, by utilizing the stored data of the motion path formula, permits entirely new speed patterns to be utilized. Thus, in the initial phase, that is to say, after the change of direction of the weft insert carriage, in contrast to the sinusoidal (speed/time) function, there may be provided an accelerated or protracted start up. Where there is a change in the material utilized in the weft threads, the motion path function can also be changed. This may be either a new function entered into the storage means via a keyboard, or the selection from the plurality of previously stored functions. Thus, all that is required is a simple keyboard input or even just a single key stroke in order to make the change necessary to work with other weft threads.

It is important that the motion of the weft insert carriage is precisely coordinated and synchronized with the work of the remaining portion of the warp knitting machine. This was automatically provided where the drive was directly controlled by the main shaft of the warp knitting machine. Such a synchronization is now, however, similarly provided by the computer which, for this purpose, takes into account data from the main shaft in outputting its signals to the servomotor.

In sum therefore, a higher machine production may be obtained by these working conditions.

It is further advisable to provide a position signalling means for generating data on the position of the weft insert carriage whereby the computer determines the drive speed, taking into account this data from the position signalling means. Thus, the synchronization with the warp knitting machine is further improved. Synchronization errors may be compensated out by rather small changes in the drive speed.

It is advantageous if the position signalling means comprises a path distance measuring means and a reference signal transducer, which is activated when the weft insert carriage takes up a predetermined reference position. By means of the reference signal transducer, a null point in the measuring path is established so that the path measurement becomes increasingly accurate with each laying cycle.

In particular, the computer may be provided as part of a control circuit for controlling the position of the weft insert carriage. The computer may utilize the main shaft data and the motion path function parameters, to calculate a desired position value. This value may be compared with the actual position value generated by the position signaller and thus, in dependence upon the deviation from the formula, the drive speed may be set. This gives rise to a high level of accuracy while requiring no additional hardware, since a modern computer can take over these additional functions rather readily.

In a further embodiment of the invention there is provided a drive amplifier, which is supplied by the computer with a desired value for the speed. The servomotor is provided with a transducer for outputting the actual value of the speed. The drive amplifier corrects the speed of the servomotor in dependence upon the deviation from the predetermined desired value. This procedure ensures that the servomotor always operates with the desired speed, even when higher loads are provided which, generally speaking, lead to a slowing of the servomotor. This can be compensated out by the drive amplifier by raising the drive performance.

In a particularly simple embodiment, pulse generators are employed in the sensor for the gathering of the main shaft data, the position transducer for the determination of the position of the weft insert carriage, and/or the transmitter for the actual value of the speed. Pulse generators are rather inexpensive but nevertheless, precise measuring elements. The pulses generated by them can very readily be processed and evaluated by the computer.

It is particularly advantageous that the servomotor be an electric motor, which readily achieves the desired drive speeds. Such a device need only be activated with the appropriate frequency. In particular, the servomotor can be a linear motor; these do not even require conversion of a rotational motion into a linear motion.

Further, the armature of the linear motor can be utilized to form the weft insert carriage. This leads to a particularly simple construction.

The servomotor can also be a brushless direct current motor or an asynchronous motor. These are types of constructions wherein the rate of rotation is readily controlled, for example, with a frequency converter.

There are several desirable embodiments. For example, the servomotor for the weft insert carriage can be driven by means a ball screw linear actuator, by means of a timing belt or by means of a rack and pinion.

It is further desirable to provide on the weft insert carriage a sled carrying the thread guides that is displaceable in a direction parallel to the forwarding means by means of a suitable control arrangement. This parallel displacement provides a very simple way to lay the weft threads around the holding elements of the forwarding means.

In one embodiment, the control arrangement comprises a guide shelf by which the sled is guided. In an alternative mode, the control arrangement comprises a second servomotor which is similarly controlled by the computer.

BRIEF DESCRIPTION OF THE DRAWINGS

The invention may illustrated by reference to the preferred embodiments illustrated in the Examples, wherein.

DETAILED DESCRIPTION OF THE PREFERRED EMBODIMENT

Figure 1:
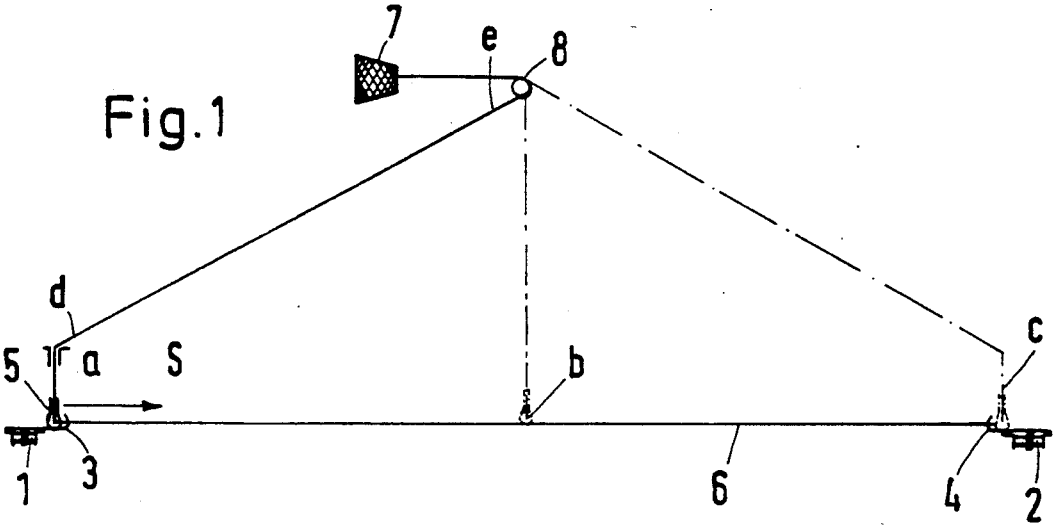
FIG. 1 is a schematic representation of a weft thread laying arrangement.

FIG. 1 shows a pair of forwarding means 1 and 2 which are parallel endless chains extending perpendicularly to the plane o the drawing. Means 1 and 2 are provided with hooks 3 and 4 operating as holding means for holding weft thread 6. By means of thread guides 5, segments of weft thread 6 are laid between these hooks. The weft threads are provided from spools 7 in creels (not illustrated) and led over a turning roller 8 located substantially midway above the laid weft threads. The thread guides 5 are moved in the direction of path arrow S from the initial position "a" over a central position "b" to the end position "c". There the thread guides are moved parallel to the forwarding means 2, whereby the threads can be laid around the hooks 4. Then the thread guides 7 are moved back into position "a". The length of segment "d-e" is thus altered so that the in the travel from the left side to the middle, segment "d-e", already contains a segment of "a-b".

Figure 2:
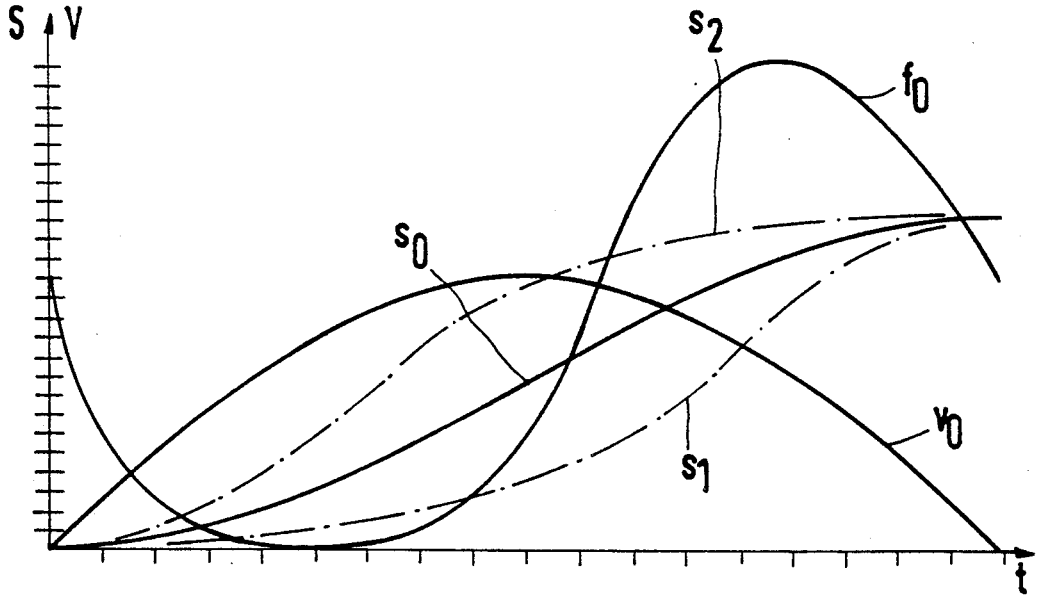
FIG. 2A is a plot of the position of the weft thread carriage against time in four different modes.
FIG. 2B is a plot of the velocity of the weft thread carriage against time in the modes shown in FIG. 2A.
FIG. 2C is a plot of the thread take-off speed of the weft thread against time in the mode shown in FIG. 2A.
Figure 2A:
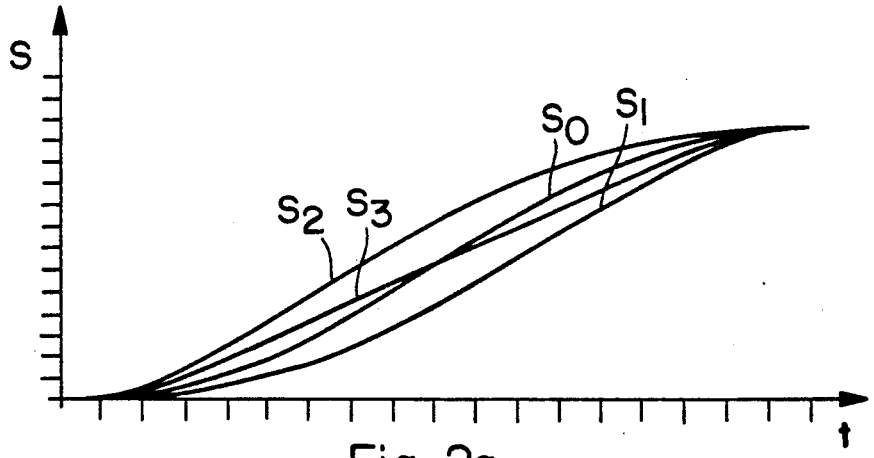

FIG. 2A, B and C illustrate the path and speed of thread guides 5 over the laying path S over time "t", as well as that of the thread take-off speed.

FIG. 2 illustrates the path of thread guides 5 over the laying path S over time "t". The curve s. shows the conventional sinusoidal shape when the weft insert carriage is driven by a drive connected to the main shaft of the warp knitting machine. This path trajectory corresponds to the speed curve $v_o$. Additionally, the curve $f_o$ is shows the weft thread takeoff speed, as provided by the arrangement of FIG. 1. These substantial speed oscillations give to corresponding strains on the weft thread.

In accordance with the present invention, a motion path formula represented by such curve is freely selectable. If one chooses another path curve "s", there is thus provided a different characteristic velocity profile "v" for the speed of the weft insert carriage. This in turn leads to another characteristic curve "f" for the takeoff speed of the weft thread. While the motion path formula corresponding to curve $s_1$ corresponds to a protracted start, the motion formula in accordance with path characteristic curve $s_2$ shows the conditions pertaining to an accelerated start.

In choosing curve $s_1$ the lower start speed of the weft insert carriage also corresponds to a lower initial speed of the weft thread. This is very desirable with thin and sensitive threads, since the threads are subjected to less strain at the start of the motion. In the last third of the travel path however, the thread speed is greater than $f_0$. The curve $s_2$ is chosen in order to more rapidly traverse the segment shown from the left side to the center of FIG. 1 because a portion of the weft thread 6 is already provided in the segment "d-e". Since the weft insert carriage runs more slowly in the second half of the path, the thread takeoff speed in this segment is smaller than that shown in characteristic curve $f_0$. Similarly, $s_3$ is a nonsinusoidal path.

Figure 2B:
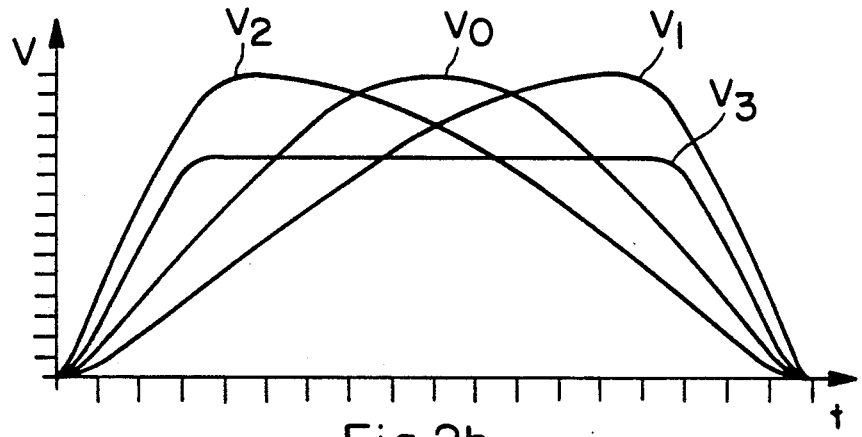
Figure 2C:
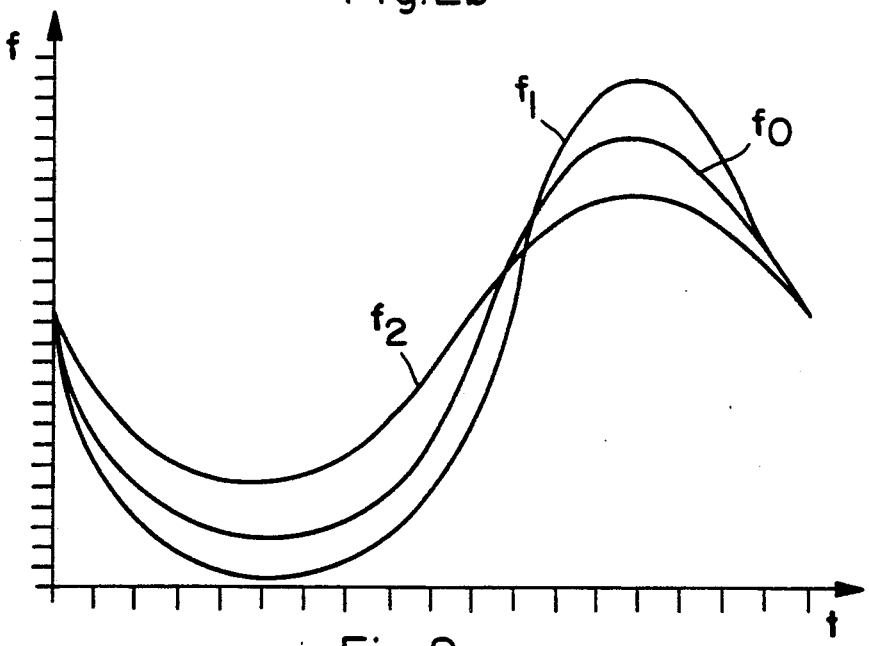

Thus, In FIG. 2B $v_0$, $v_1$, $v_2$ and $v_3$ correspond to the velocities of the trajectories $s_0$, $s_1 s_2$ and $s_3$ and in FIG. 2C, $f_0$, $f_1$, and $f_2$ correspond to the appropriate thread speeds for the foregoing trajectories $s_0$, $s_1$ and $2_2$, respectively.

The time segments on the ordinate each represent one rotation of the main shaft. For example, where there are 18 rotations of the main shaft corresponding to a single movement of the thread guide 5 between end points "a" and "c", then 18 weft threads are laid at the same time.

Thus, FIG. 2 shows the motion path formula in the normal sinusoidal fashion, as well as one with a protracted ($S_1$), one with an accelerated path start ($S_2$) and one with a nonsinusoidal path ($S_3$). Other mathematically based motion formulae can also be considered which have a symmetric or asymmetric progression. Such motion path formulae are already well known.

Figure 3:
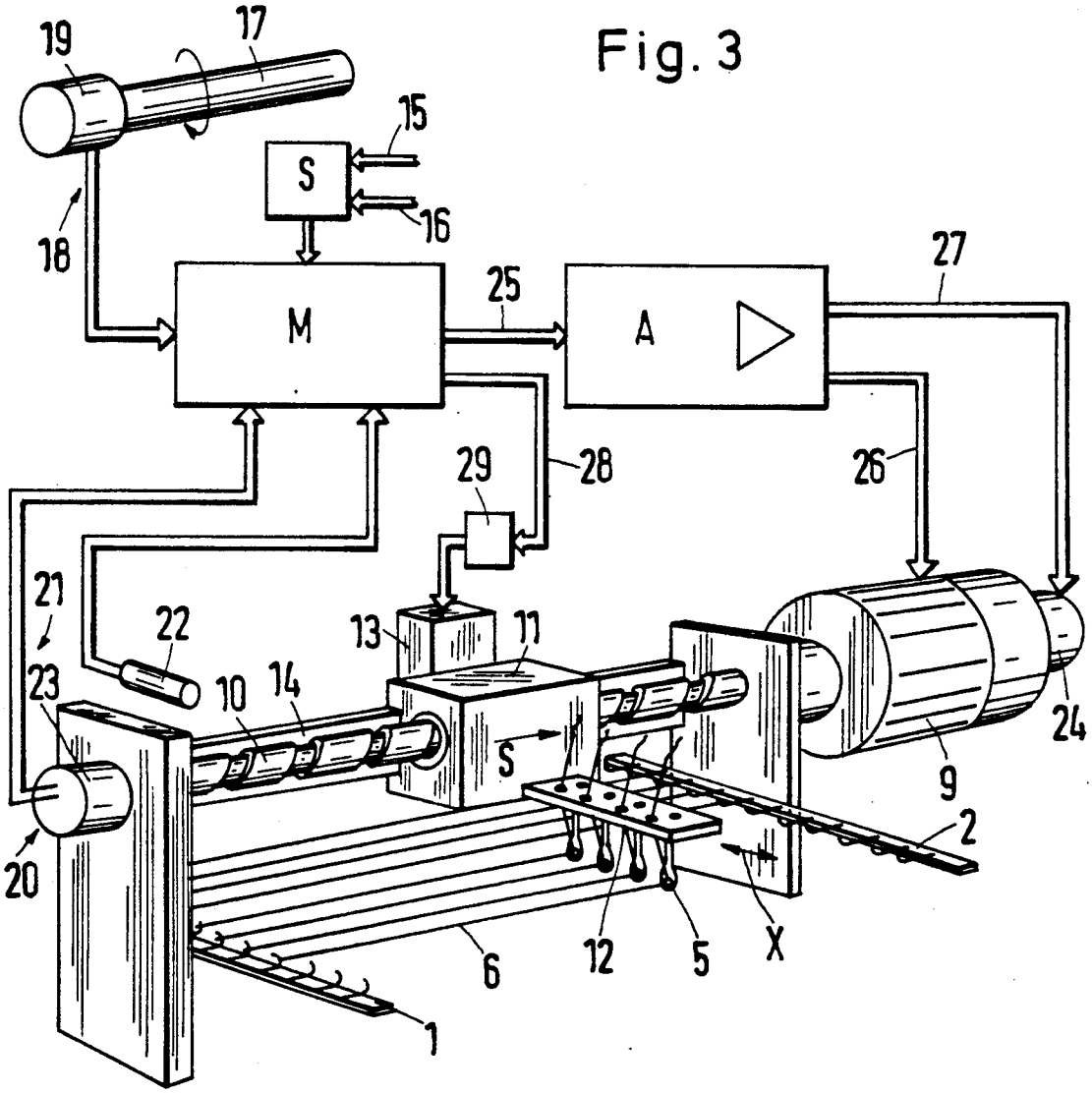
FIG. 3 is a partially schematic, partially perspective view of the weft thread provision arrangement in accordance with this invention.

In the embodiment illustrated in FIG. 3, there is provided a brushless direct current motor which drives a ball screw linear actuator 10 on which the weft insert carriage 11 is moveable to and fro in the direction of arrow S. The weft insert carriage 11 carries the thread guides 5 below sled 12. Sled 12 is axially slidable on carriage 11 in the direction of double headed arrow X by means of a second servomotor 13. Sled 12 is reciprocated at the turnaround point of the travel path of carriage 11. A fixed weft insert carriage guide 14 extends parallel to the actuator 10 and slides through carriage 11.

Servomotor 9 is controlled by the combined action of computer M with drive amplifier A. A data storage means S is provided to the computer. Storage means S may be 256 kb of RAM memory, although other size memories may be used depending upon the complexity of the programming and the desired precision of the control function. Computer M may be any computing device, including a microprocessor such as Intel type 80386. Utilizing data input means 15 which may, for example, be a keyboard, the parameters for the desired motion path formula may be entered. Via a selection input means 16, any one of several motion path formulae may be selected.

A sensor 18 is utilized to read angular displacement data from the main shaft 17 of the warp knitting machine. These angular data include the number of rotations (this is reduced to the rotational speed) and the rotational angle (that is, the position). For this purpose, it is desirable to use a sensor having a pulse generator 19. The pulses are accumulated and converted by the computer M into position and speed data.

Weft insert carriage 11 is provided with a position transducer 20. Transducer 20 comprises a path distance measuring means 21 and a reference signal generator 22. The path distance measuring means further comprises a pulse generator 23, which produces pulses in proportion to the rotation of the ball screw linear actuator 10. Generator 23, in combination with computer M, enables determination of the position value assigned to the weft insert carriage 11. The reference signal generator 22 is activated when the weft insert carriage 11 reaches a predetermined end position. Generator 22 may be a proximity detector comprising an optical sensor, proximity switch or similar devices. This arrangement gives rise to a reference point for the path distance measured by the path distance measuring means 21. For example, a register in computer M can be reset to a predetermined count when generator 22 issues a pulse. Thereafter, this count can be decremented (or incremented) to indicate relative displacement from the reference point.

The servomotor 9 is provided with a transducer 24 in the form of a tachometer generator for measuring the actual value of the motor speed.

During the procedure, computer M derives data from the motion path formula from the storage means S with a speed predetermined by the number of rotations of the main shaft 17, wherein the starting point corresponds to the particular position of main shaft 17. In this way, the turning of the main shaft 17 may be used to provide target position values for weft insert carriage 11. These target values are compared with the actual position values, which are provided by means of the position transducer 20. In dependence upon the deviation from the desired values, the drive speed is either maintained or corrected. In some embodiments a proportional integral control loop can be employed to develop a target speed value.

This target speed signal is thus provided via output 25 of computer M to amplifier A as a desired speed value. Amplifier A may be a voltage-controlled, variable frequency converter, which provides servomotor 9 via power lines 26 a potential at a variable frequency. The actual speed of the servomotor is determined by the actual value transducer 24 whose data is transmitted to amplifier A via feedback line 27. If the desired and actual values do not correspond with each other, for example if there is too heavy a load on the servomotor, this is corrected by amplifier A.

Figure 8:
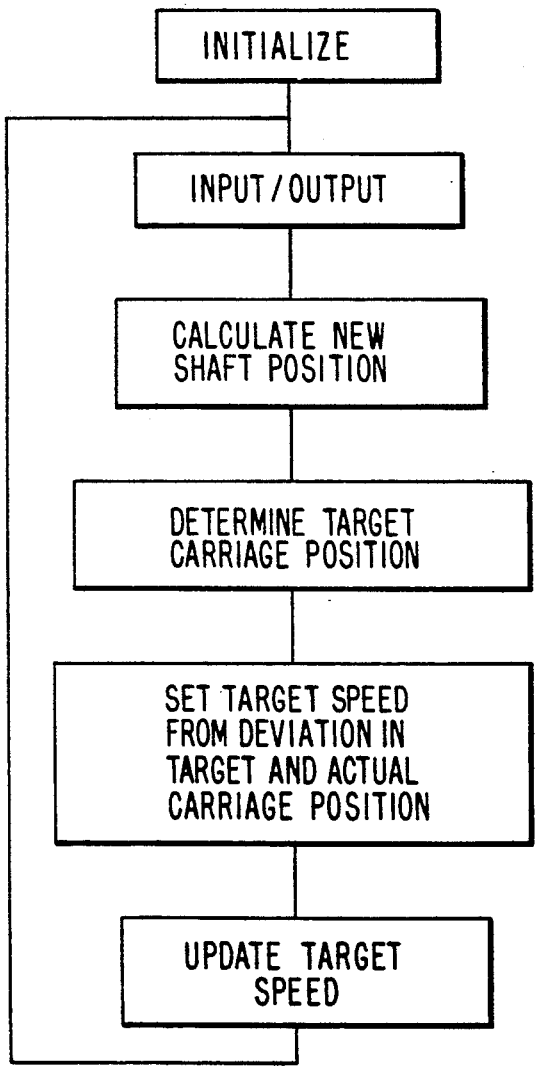
FIG. 8 is a flowchart associated with the programming of the computer of FIG. 3.

The programming of computer can be in any appropriate language and, if desired, compiled for quick response. The exemplary flowchart of FIG. 8 shows an initializing routine where various computer registers are set to nominal operating parameter that determine the frequency of updating, the starting point of variables etc. Thereafter data input/output is accomplished. For example, any revised output signals can be transmitted at this time to amplifier A and servomotor 29. Also transducers 18 and 20 may be read, as well as control inputs from ports 15 and 16 Alternatively, input data can be handled by an interrupt handler that interrupts the routine program process to allow fresh data or operator input to be stored in memory before returning to routine processing. As indicated in the third program step, computer M updates the main shaft position based upon the receipt on any new pulses from transducer 19.

Next, the program uses the newly calculated shaft position to determined the target position for the carriage 11. The determination can be obtained from a lookup table or by a mathematical formula. In the last two step the difference between the target and actual carriage position is used to calculate a target carriage speed, as described above.

A second output 28 of computer M operates a second servomotor 13, which is only activated at the turnaround point of carriage 11.

When it is desired to use other weft threads whose utilization calls for other motion path formulae, only a simple key stroke is required in order to select this motion path formula via selection means 16 and to continue with this new operation.

Figure 4:
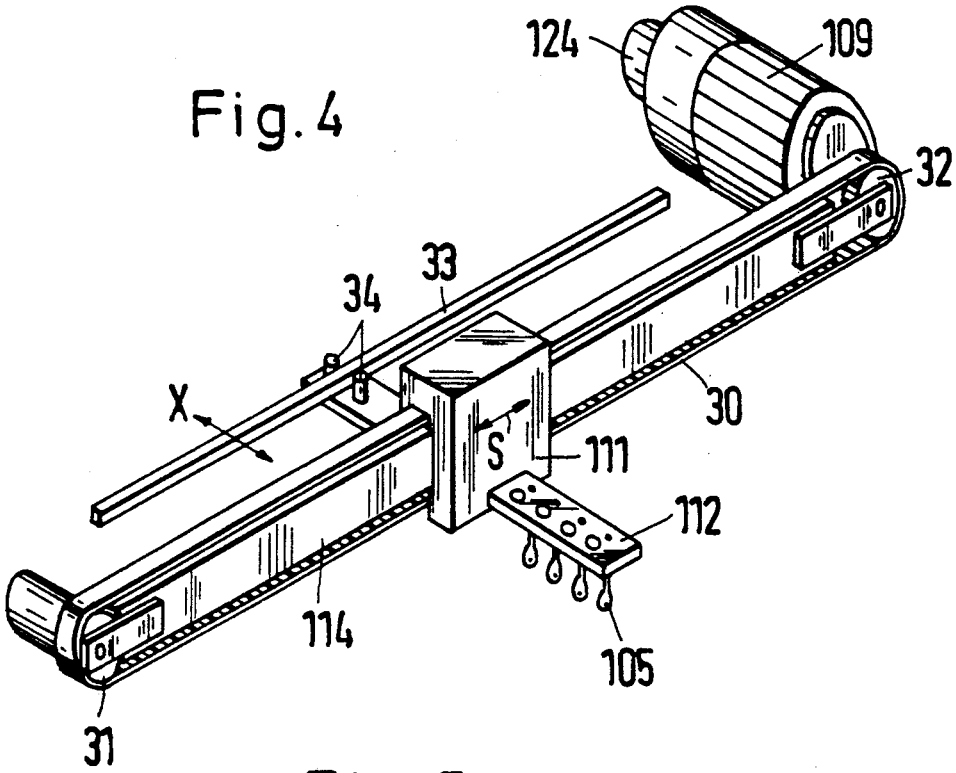
FIG. 4 is a partial perspective view of an alternate embodiment employing a timing belt in the transport mechanism.

In the embodiment illustrated in FIG. 4, parts corresponding to those previously illustrated are renumbered by raising their reference numerals by 100. The weft insert carriage 111 is moved to and fro in the direction of arrow S by means of a timing belt 30. The timing belt is laid around a rotatable idler 31 and about a further roller 33 driven by servomotor 109. Sled 112 has a tail projecting beyond carriage 111 to a side opposite guides 105. In order to drive sled 112 in the direction of arrow X, there is provided a guide shelf 33 which fits between guide pegs 34 on sled 112. The shelf 33 can be moved to and fro in the direction of arrow X by means of mechanisms which are not illustrated; for example, by a conventional cam or lever or by means of a second servomotor.

Figure 5:
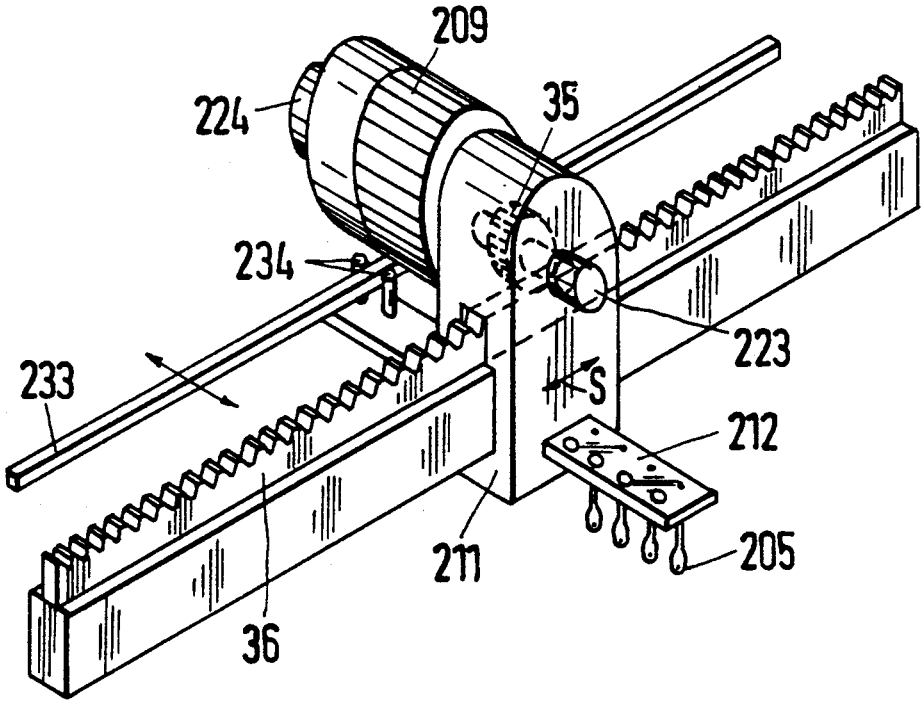
FIG. 5 is a partial perspective view of a further embodiment employing a rack and pinion in the transport mechanism.

In the embodiment illustrated in FIG. 5, parts corresponding to those previously illustrated are renumbered by raising their reference numerals by 200. Servomotor 209 has a pinion 35 and is supported by weft insert carriage 211. Carriage 211 encircles a rack 36 that is adjacent to and engages pinion 35. Operation of servomotor 209 turns pinion 35 to engage rack 36 and produce a reactive force that moves carriage 211.

Figure 6:
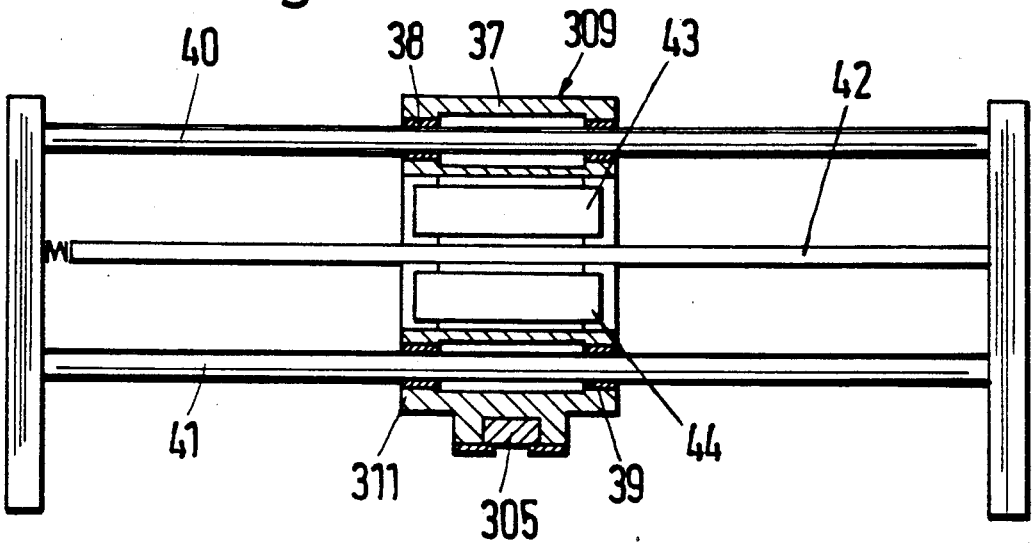
FIG. 6 is a rear elevational view of yet another embodiment employing a linear motor in the transport mechanism.
Figure 7:
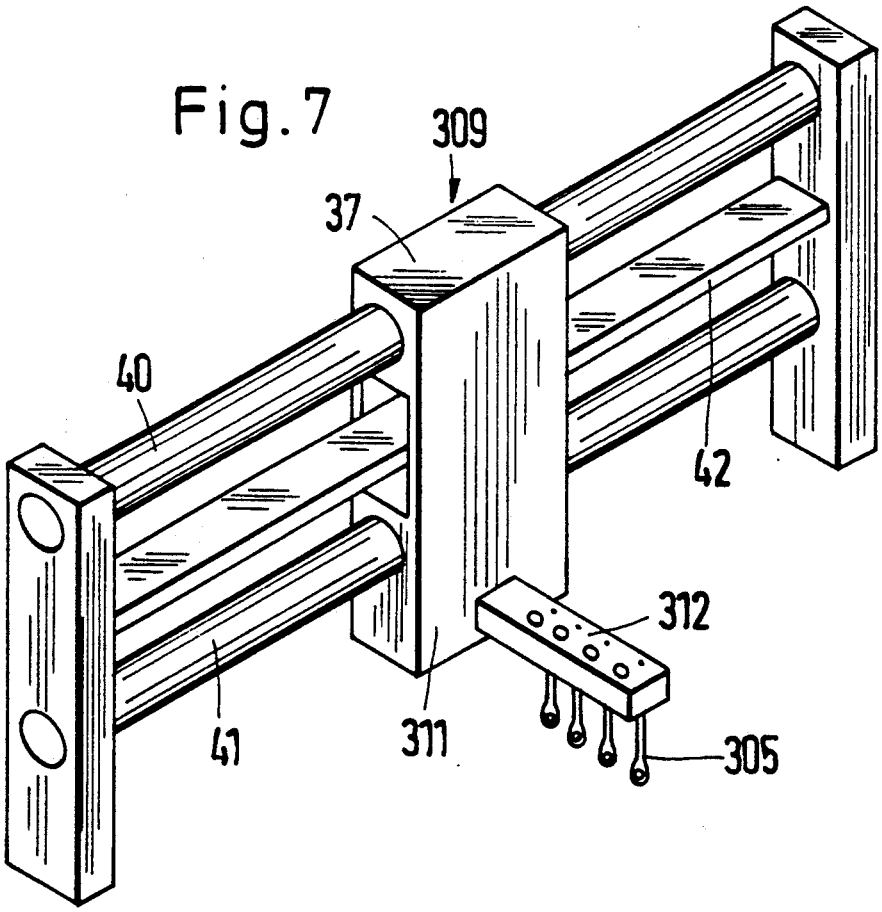
FIG. 7 is a front perspective view of the mechanism of FIG. 6.

In the embodiment illustrated in FIGS. 6 and 7, parts corresponding to those previously illustrated are renumbered by raising their reference numerals by 300. Here, the weft insert carriage 311 is integrated in the armature 37 of a servomotor 309, provided as a linear motor. Carriage 311 is a rectangular block with a rectangular passage holding inductors 43 and 44 on opposite sides of anchor 42. This linear motor is guided by guide sleeves 38 and 39 mounted on opposite hollows in carriage 311. Sleeves 38 and 39 ride on guide rods 40 and 41 mounted on opposite sides of and parallel to anchor 42. The linear motor action is provided by inductors 43 and 44 acting on anchor 42.

The invention is described with respect to the continuous provision of weft threads 6 laid by thread guides 5 moving to and fro as a reversing weft thread magazine. In an alternate magazine the weft threads are grasped by grasping tongs attached to a weft insert carriage and are only laid in one direction between the thread forwarding means. Such laid weft thread segments are cut from the spool as soon as they are clamped onto a thread forwarding means.

We claim:

1. A weft thread insertion arrangement for the weft thread magazine of a warp knitting machine adapted to receive weft thread and having a main shaft and a needle bed, comprising:

an insert carriage for laying weft thread;

two forwarding means for forwarding to the needle bed the weft threads laid by said insert carriage;

a drive means for driving said insert carriage to travel between said two forwarding means, said drive means being coupled to and regulated by the main shaft of the warp knitting machine, said drive means comprising a computer provided with at least one data storage means and programed to process data under at least one predetermined movement path formula;

a servomotor coupled to said computer and coupled to said insert carriage to move the carriage; and a sensor coupled to said computer for providing thereto a sensor signal responsive to the number of revolutions and the angular displacement position of the main shaft to enable the computer to compute from the sensor signal a target drive speed value for the servomotor based upon said sensor signal and based upon said predetermined movement path formula.

2. An arrangement in accordance with claim 1, further comprising;

a position transducer coupled to said computer for providing thereto a carriage signal signifying the position of the insert carriage to enable said computer to compute the target drive speed value as a function of the carriage signal.

3. An arrangement in accordance with claim 2, wherein said position transducer comprises:

a measuring means for measuring the path distance travelled by said insert carriage; and a reference signal generator for signaling when said insert carriage occupies a predetermined reference position.

4. An arrangement in accordance with claim 2 wherein said computer comprises:

a control circuit responsive to said carriage signal for determining an actual position value corresponding to the actual position of the insert carriage, and for computing from the sensor signal by means of the predetermined movement path formula a target position value for the insert carriage, said control circuit being operable to compare said target position value with said actual position value and to calculate based upon the comparison the target drive speed value.

5. An arrangement in accordance with claim 4, additionally comprising:

a drive amplifier coupled to said computer; and a speed transducer coupled to said servomotor and said drive amplifier for feeding back to the latter an actual speed value, said computer being operable to impart said target drive speed value to said amplifier, said drive amplifier being operable to correct the speed of the servomotor in response to the deviation between the target drive speed and the actual speed value.

6. An arrangement in accordance with claim 5, wherein said sensor, said position transducer and said speed transducer each comprise an pulse generator.

7. An arrangement in accordance with claim 6, wherein said servomotor is an electric motor.

8. An arrangement in accordance with claim 7, wherein said servomotor is a linear motor.

9. An arrangement in accordance with claim 8, the insert carriage comprises an armature arranged to be driven by said linear motor.

10. An arrangement in accordance with claim 7, wherein the servomotor is either a brushless direct current motor or an asynchronous motor.

11. An arrangement in accordance with claim 10 further comprising:

a ball screw linear actuator driven by said servomotor to drive said insert carriage.

12. An arrangement in accordance with claim 10 further comprising:

a timing belt driven by said servomotor to drive the insert carriage.

13. An arrangement in accordance with claim 10, wherein said servomotor is mounted on said insert carriage, said arrangement comprising a rack and pinion driven by the servomotor to drive the insert carriage.

14. An arrangement in accordance with claim 13, wherein said insert carriage comprises:

a sled having thread guides; and a control means for displacing said sled parallel to the forwarding means.

15. An arrangement in accordance with claim 14, wherein said control means comprises a guide shelf slidably connected to said sled, said sled being operable to run along said guide shelf.

16. An arrangement according to claim 14, wherein said control means comprises a second motor controlled by said computer.

17. A weft thread insertion arrangement for the weft thread magazine of a warp knitting machine adapted to receive weft thread and having a main shaft and a needle bed, comprising:

an insert carriage for laying weft thread;

two forwarding means for forwarding to the needle bed the weft threads laid by said insert carriage;

a drive means for driving said insert carriage to travel between said two forwarding means, said drive means being coupled to and regulated by the main shaft of the warp knitting machine, said drive means comprising a computer provided with at least one data storage means and programed to process data under at least one predetermined movement path formula;

a servomotor coupled to said computer and coupled to said insert carriage to move the carriage;

a sensor coupled to said computer for providing thereto a sensor signal responsive to the number of revolutions and the angular displacement position of the main shaft to enable the computer to compute from the sensor signal a target drive speed value for the servomotor based upon said sensor signal and based upon said predetermined movement path formula; and a position transducer coupled to said computer for providing thereto a carriage signal signifying the position of the insert carriage to enable said computer to compute the target drive speed value as a function of the carriage signal.

* * * * *